US012760485B2

(12) United States Patent
Noyes et al.

(10) Patent No.: US 12,760,485 B2
(45) Date of Patent: Oct. 13, 2026

(54) STACKED CONE PENETROMETER TESTING SOUNDING UNIT

(71) Applicant: Applied Research Associates, Inc., Albuquerque, NM (US)

(72) Inventors: Devin Noyes, Bethel, VT (US); Travis Lowe, Randolph, VT (US); Tyson Burrell, Randolph, VT (US); Zubin Jeandell, Englewood, CO (US); Jesse Mastine, Bethel, VT (US)

(73) Assignee: Applied Research Associates, Inc., Albuquerque, NM (US)

( * ) Notice: Subject to any disclaimer, the term of this patent is extended or adjusted under 35 U.S.C. 154(b) by 285 days.

(21) Appl. No.: 18/744,039

(22) Filed: Jun. 14, 2024

(65) Prior Publication Data

US 2024/0417944 A1 Dec. 19, 2024

Related U.S. Application Data

(60) Provisional application No. 63/508,746, filed on Jun. 16, 2023.

(51) Int. Cl.
*E02D 1/04* (2006.01)
*E02D 1/02* (2006.01)

(52) U.S. Cl.
CPC ..... *E02D 1/04* (2013.01); *E02D 1/027* (2013.01)

(58) Field of Classification Search
CPC .. E02D 1/04; E02D 1/027; E02D 1/02; E02D 1/022
See application file for complete search history.

(56) References Cited

U.S. PATENT DOCUMENTS 6,352,002 B1 * 3/2002 Weijer ..... G01V 3/34 73/864.74
2003/0141110 A1 * 7/2003 Jonsson ..... E21B 47/13 175/50
2015/0136491 A1 * 5/2015 White ..... E21B 43/126 175/57

* cited by examiner

*Primary Examiner* — David Z Huang
(74) *Attorney, Agent, or Firm* — Erise IP, P.A.

(57) ABSTRACT

Embodiments of the disclosure provide a cone penetrometer test sounding system (CPTSS) and methods of operation. The CPTSS comprises an upper clamp and a lower clamp in a vertical orientation such that a rod string may span both the upper and lower clamp assemblies. The upper clamp assembly may work in cooperation with the lower clamp assembly to continuously push the rod string comprising a cone penetrometer into the ground to test the ground soil. The upper clamp assembly may clamp the rod string and push the cone penetrometer into the ground while the lower clamp assembly moves upward while not engaged with the rod string. The lower clamp assembly may then engage the rod string while the upper clamp assembly disengages the rod string, and the lower clamp assembly then pushes the cone penetrometer into the ground in a hand-over-hand method.

20 Claims, 10 Drawing Sheets

STACKED CONE PENETROMETER TESTING SOUNDING UNIT

RELATED APPLICATIONS

This application claims the benefit of U.S. Provisional Application No. 63/508,746, entitled "EXCAVATOR-MOUNTED CONE PENETROMETER TESTING SOUNDING UNIT," and filed on Jun. 16, 2023, which is herein incorporated by reference in its entirety.

BACKGROUND

1. Field

Embodiments of the disclosure generally relate to a ground sounding unit. More specifically, embodiments of the disclosure relate to a continuous push stacked cone penetrometer testing sounding system.

2. Related Art

Generally, cone penetrometer test sounding units detect characteristics of soil for various applications. Typical systems utilize hydraulic or pneumatic cylinders to press a rod string by comprising a sounding cone into the ground to test the soil. The sounding cones typically comprise various sensors for detecting soil characteristics. In typical systems, the sounding cone is pressed into the soil at a constant rate while the sensors detect soil resistance, bearing capacity, water pressure, soil temperature, as well as other characteristics. These soil characteristics may be useful in many fields such as, for example, drilling, construction, and many more.

There are several drawbacks to current systems and methods. Typical systems are either smaller devices on wheels and transported by a user or are mountable on heavier construction machinery. These devices can be difficult to maneuver from one location to another depending on the construction machinery to which the typical CPT are coupled. Furthermore, the lightweight manual devices rely on weight to press into the ground, so they are limited to less dense soils and shallow penetration depths. Furthermore, as these typical devices utilize a single pressing device to press the rod string into the soil, each time the pressing device reaches an end to its stroke, operations must stop while the pressing device resets for another push. This process increases work time as there are moments between each push that are wasted while resetting the CPT. Furthermore, typical systems require an operator to add rods to the rod string during operation. The operator must climb onto the machine and add a rod between pushes. Again, this slows operation wasting valuable work time.

SUMMARY

Embodiments of the current disclosure solve the above-described problems and provide a distinct advance in the art by providing a cone penetrometer test sounding system (CPTSS) that provides a continuous push of the rod string and may be easily and quickly positioned for operation.

An embodiment of the disclosure comprises a cone penetrometer testing sounding system for testing ground soil, including a rod string including a plurality of connected rods; an upper head clamp assembly including at least one upper clamp configured to selectively engage the rod string, a lower head clamp assembly including at least one lower clamp configured to selectively engage the rod string, wherein the upper head clamp assembly and the lower head clamp assembly are positioned in a vertical configuration with the upper head clamp assembly above the lower head clamp assembly, a cone penetrometer including at least one sensor configured to detect ground soil characteristics, wherein the cone penetrometer is configured to be coupled to a ground penetrating end of the rod string, a hydraulic network configured to supply hydraulic power to the upper head clamp assembly and the lower head clamp assembly, wherein, under a first force applied by the hydraulic network, the at least one upper clamp is configured to engage the rod string, wherein, under a second force applied by the hydraulic network, the at least one lower clamp is configured to disengage the rod string, wherein, under a third force applied by the hydraulic network, the upper head clamp assembly is configured to move downward forcing the cone penetrometer into the ground soil, and wherein, under a fourth force applied by the hydraulic network, the lower head clamp assembly is configured to move upward away from the ground soil.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of this disclosure are described in detail below with reference to the attached drawing figures, wherein.

Figure 1:
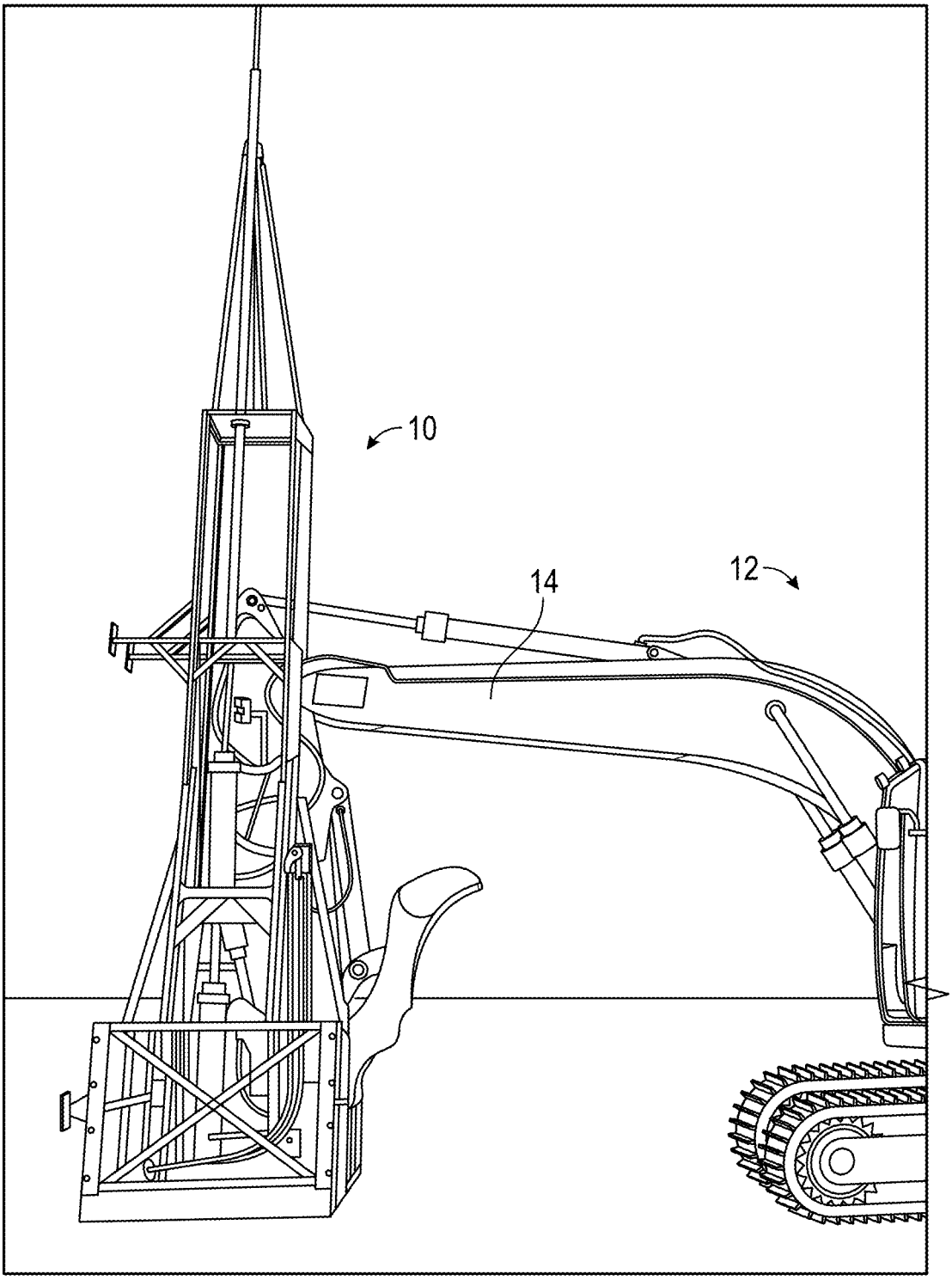
FIG. 1 depicts an exemplary CPTSS coupled to an excavator and configured vertically for some embodiments of the disclosure.

The drawing figures do not limit the invention to the specific embodiments disclosed and described herein. The drawings are not necessarily to scale, emphasis instead being placed upon clearly illustrating the principles of the invention.

DETAILED DESCRIPTION

The following description of embodiments of the invention references the accompanying illustrations that illustrate specific embodiments in which the invention can be practiced. The embodiments are intended to describe aspects of the invention in sufficient detail to enable those skilled in the art to practice the invention. Other embodiments can be utilized, and changes can be made, without departing from the scope of the invention. The following detailed description is, therefore, not to be taken in a limiting sense.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Generally, embodiments of the current disclosure relate to a cone penetrometer test sounding system (CPTSS). The CPTSS comprises stacked head clamp assemblies comprising an upper clamp assembly and a lower clamp assembly. In operation, the stacked clamping units may work in combination to continuously or near continuously push a rod string comprising a plurality of coupled rods into the ground to test the ground soil. A sounding cone penetrometer comprising various sensors for detecting a state of the soil may be attached to an end rod at a distal end, or a ground penetrating end, of the rod string for insertion into the ground. As the rod is continually and, in some embodiments, constantly pushed into the soil a worker may attach additional rods to the rod string at the back end, or proximal end of the rod string. However, in some embodiments, all rods may be attached prior to operation.

In some embodiments, the stacked head clamp assemblies may work in combination to continuously push the rod string into the ground. Each head clamp assembly may comprise clamps that, when engaged, couple the head clamp assemblies to the rod string. Hydraulic valves may be manually or automatically controlled to operate the head clamp assemblies and the clamps to continually push the rod string into the ground.

In some embodiments, an upper head clamp assembly may be operable to clamp onto the rod string and move under hydraulic power downward toward the ground pressing the rod string into the ground. At the same time, a lower head clamp assembly may be forced upward by hydraulic power while not engaged with the rod string. When a lower limit (lower maximum stroke) of the upper head clamp assembly is reach, the upper clamps may disengage the rod string. Similarly, or alternatively, as an upper limit (upper maximum stroke) of the lower head clamp is reached, the lower clamps may engage a rod of the rod string. The actions of the upper head clamp assembly and the lower head clamp assembly may occur approximately simultaneously. Now, the upper head clamp assembly is at its lowest point and disengaged from the rod string, and the lower head clamp assembly is at its highest point and the lower clamps are engaged with the rod string. Under hydraulic power again the lower head clamp assembly may move downward pressing the rod string into the ground while the upper head clamp assembly moves upward back to its starting or initial position. This action may repeat until the cone penetrometer sounding test is complete, anomalies are detected, or operations are stopped by a CPTSS operator.

FIG. 1 depicts an embodiment of CPTSS 10 in vertical configuration attached to an exemplary excavator 12. Though CPTSS 10 may be self-contained and operate completely independently of any auxiliary machines, additional machinery may be utilized in the field to quickly move CPTSS 10 from test location to test location. Here, exemplary excavator 12 is shown. Excavator 12 is exemplary and any machine (e.g., a crane, bulldozer, heavy duty truck, and the like) may be used. CPTSS 10 may be attached to an excavator boom 14 of excavator 12 such that CPTSS 10 may be lifted, rotated, and placed vertically as shown for testing various locations. In these scenarios, CPTSS operator may operate excavator 12 to move CPTSS 10 around a job site testing various locations.

Figure 2:
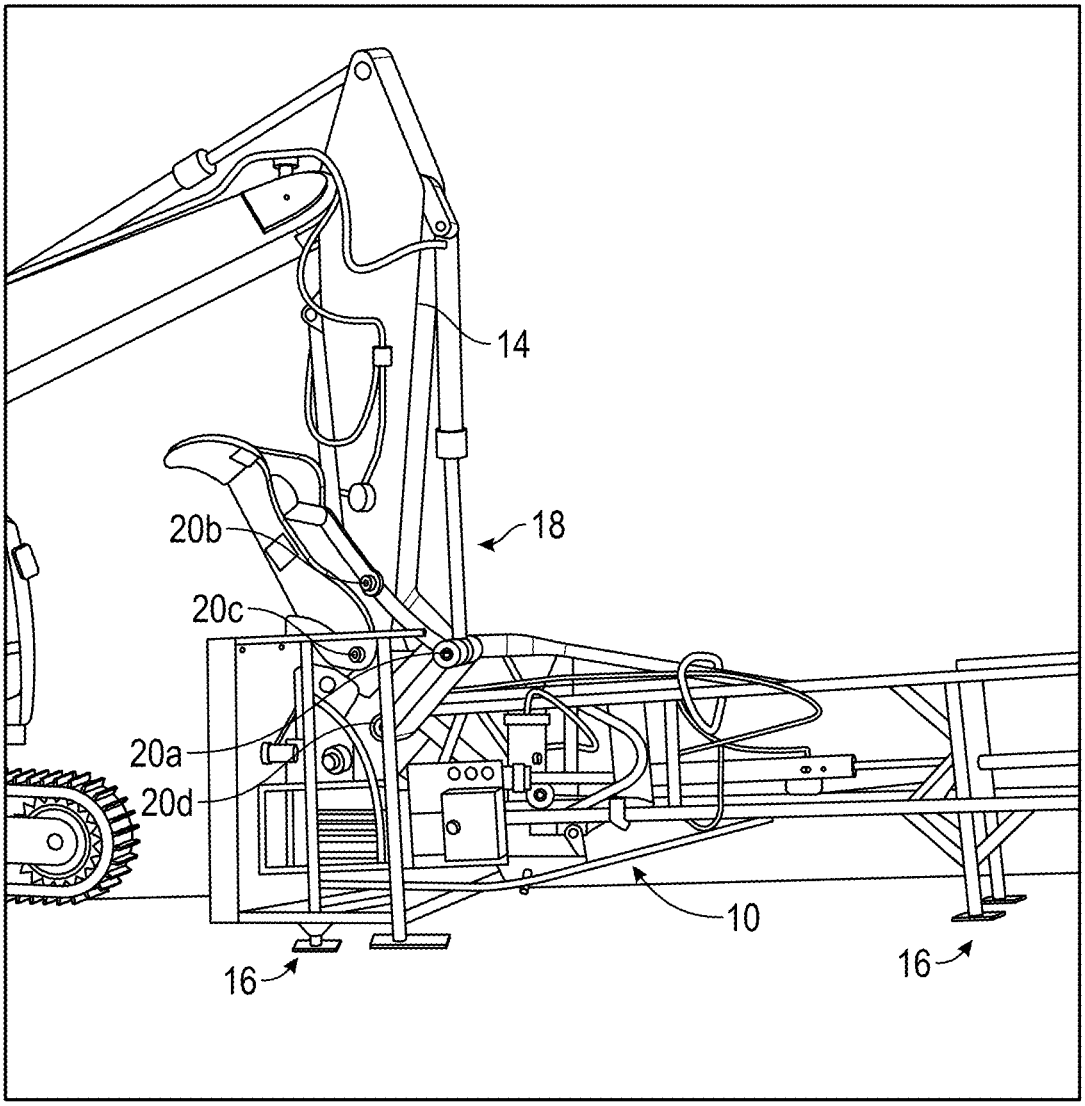
FIG. 2 depicts the exemplary CPTSS coupled to the excavator and configured horizontally for some embodiments of the disclosure.

In some embodiments, CPTSS 10 may be coupled to the excavator boom 14 of excavator 12 at attachment points 20*a*, 20*b*, 20*c*, 20*d* as shown in FIG. 2. Excavator boom 14 may be operational to extend by actuator 18 to provide CPTSS 10 in a vertical position (FIG. 1) such that components of the CPTSS 10 may penetrate the ground in a vertical direction to measure characteristics of the soil below CPTSS 10. In some embodiments, CPTSS 10 may complete subsurface, ground, and/or soil soundings 15-20 feet below grade in 1-10 minutes then move quickly to a new location for more testing.

Figure 4:
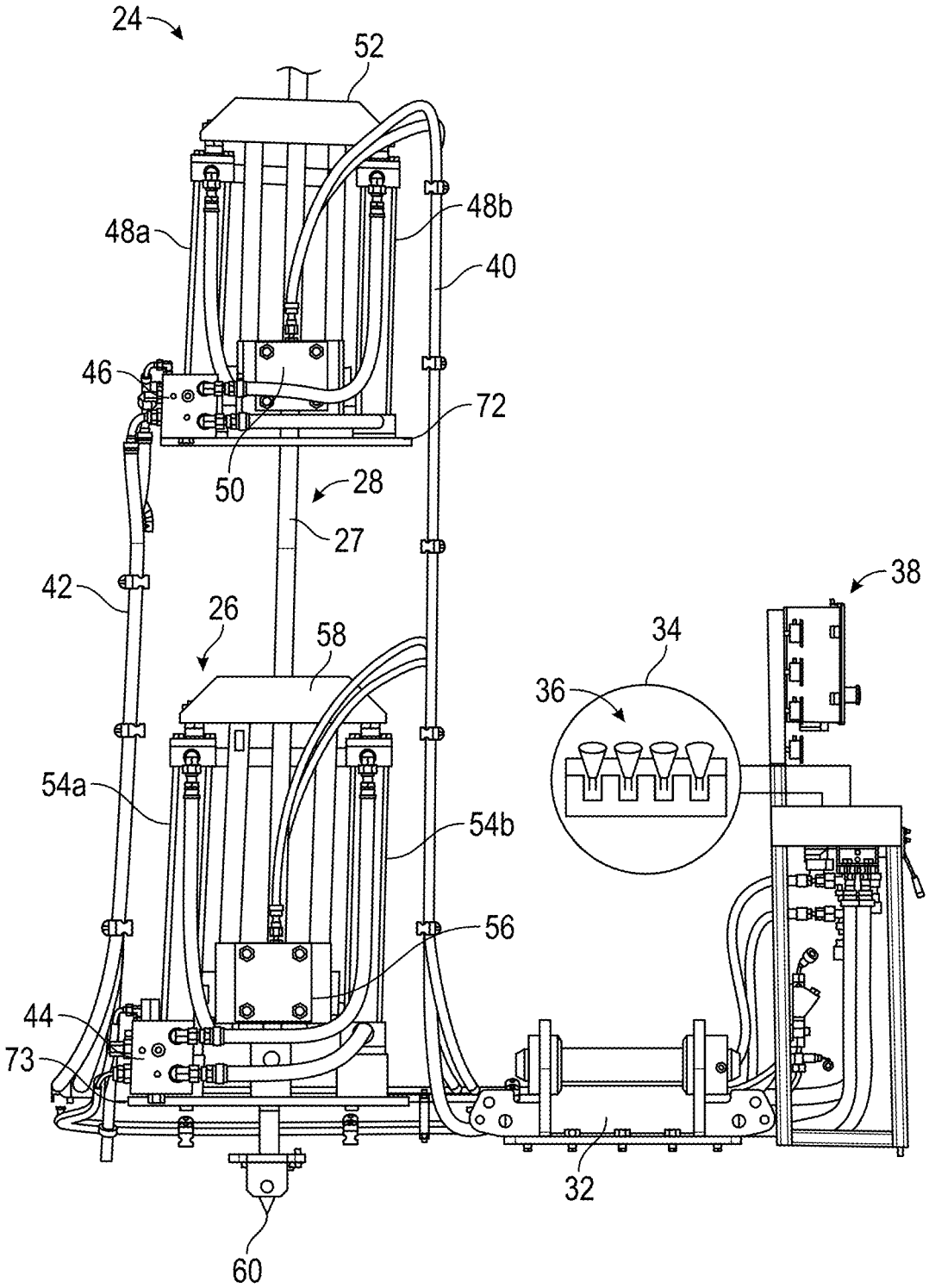
FIG. 4 depicts the embodiment of CPTSS of FIG. 3 with a frame removed illustrating an embodiment of inner components.

FIG. 2 depicts an arrangement of CPTSS 10 in a horizontal position. In this arrangement it may be easier for operators to attach rods to rod string 28. Rod string 28 comprises a plurality of rods couple together. In some embodiments, the rods may comprise threads and be coupled by screwing each new rod onto the last rod on an end of rod string 28 distal the sounding cone penetrometer 60 (FIG. 4). When CPTSS 10 is horizontal, CPTSS operators may attach rods on the ground without having to be on platform 30 and raise the rods over their heads. Furthermore, the horizontal configuration provides unlimited access to any component of CPTSS 10 for maintenance and repair. Furthermore, frame 22 of CPTSS 10 may comprise horizontal footings 16 for resting CPTSS 10 on the ground in the horizontal configuration.

Figure 3:
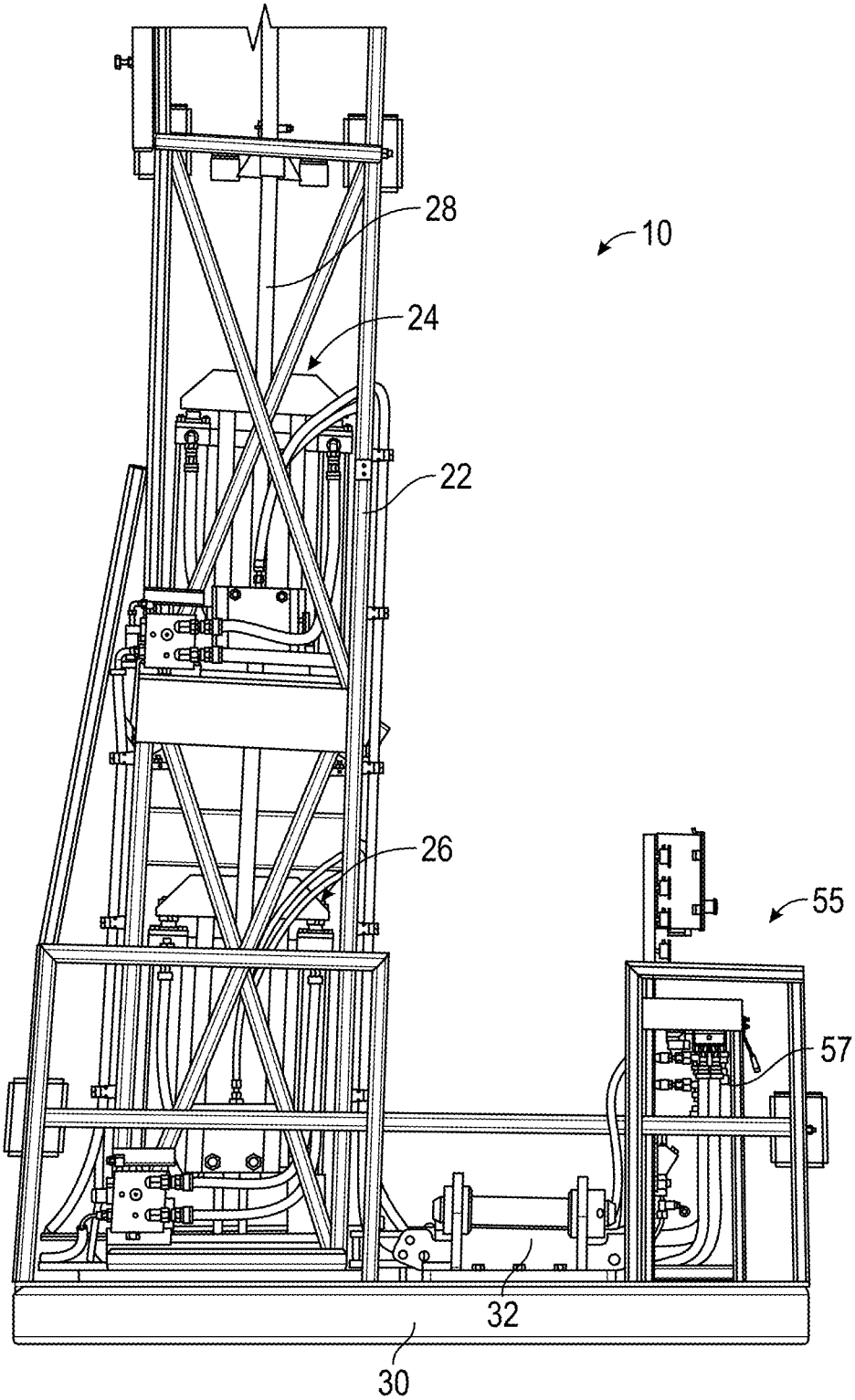
FIG. 3 depicts an embodiment of CPTSS.

FIG. 3 depicts an embodiment of CPTSS 10 in the vertical, operational, position. As shown, CPTSS 10 comprises upper head clamp assembly 24 and lower head clamp assembly 26 positioned inside, and coupled to, frame 22. In some embodiments, frame 22 provides structure to the CPTSS 10. Frame 22 provide attachment points 32 such that CPTSS 10 can be selectively coupled to excavator boom 14 of excavator 12 at platform 30. Furthermore, frame 22 provides a framework to which the operational components of CPTSS 10 are mounted. Further still, frame 22 provides durability as an exterior cage comprising a strong material such as a metal, metal alloy, composite, plastic, or the like. Frame 22 may surround upper head clamp assembly 24, lower head clamp assembly 26, rod string 28, and other moving parts placing a barrier between CPTSS operators and the moving components of CPTSS 10. In some embodiments, in the vertical configuration, upper head clamp assembly 24 and lower head clamp assembly 26 may be mounted in a stacked formation within frame 22. Frame 22 may be mounted to, or comprise, platform 30, which may be coupled to excavator boom 14 by attachment points 32.

In some embodiments, CPTSS 10 comprises a hydraulic quick connect 57 attached to the excavator enabling a quick attachment to provide hydraulic energy from excavator 12 to hydraulic network 34 of CPTSS. In some embodiments, after the hydraulic quick connect 57 is connected, a hydraulic value switch may be turned to an on state at operator's platform 55. Testing head clamp assembly controls may begin once the hydraulic connect is established. A test may be one of an open and close function or a push and pull function to test the operation of CPTSS.

FIG. 4 depicts CPTSS 10 with the above-described frame 22 removed to better illustrate the inner-workings of CPTSS 10. As shown, upper head clamp assembly 24 and lower head clamp assembly 26 are in a stacked configuration. The stacked configuration references when the head clamp assemblies are in vertical orientation with one head clamp assembly above the other. This stacked configuration provides a vertical line through upper head clamp assembly 24 and lower head clamp assembly 26 for receiving rod string 28. This configuration allows both upper head clamp assembly 24 and lower head clamp assembly 26 to move rod string 28 in the same direction without changing the configuration of CPTSS 10.

In some embodiments, energy may be provided by hydraulic network 34 controllable by hydraulic control levers 36 and comprising hydraulic lines 40, 42 leading to various cylinders and actuators disposed on upper head clamp assembly 24 and lower head clamp assembly 26 via lower distribution 44 and upper distribution 46. It should be noted that hydraulic network 34 is exemplary and that a pneumatic and/or an electrical network may be used. As the energy is provided by hydraulic lines 42 to upper head clamp assembly 24 and lower head clamp assembly 26, upper head clamp assembly 24 and lower head clamp assembly 26 may move up and down. This movement may be provided by upper hydraulic cylinders 48*a*, 48*b*, coupled to upper platform 72 and lower hydraulic cylinders 54*a* and 54*b* coupled to lower platform 73. Furthermore, as hydraulic energy is provided by clamp hydraulic lines 40, upper clamp 90 (FIGS. 8A and 8B) may engage and disengage rod string 28. Similarly, lower clamp assembly (not shown) may engage and disengage rod string 28. The combination of these movements, as described in more detail below, results in rod string 28 being forced continuously into the soil for testing.

Operation of CPTSS 10 as described herein may be achieved by manual or automatic control. In manual mode, CPTSS 10 may be operated at operator's platform 55 using hydraulic control levers 36. Operation of hydraulic network 34 comprising all valves, hydraulic motors, and hydraulic lines described herein may provide direct control of all features of CPTSS 10. CPTSS operator my apply force to hydraulic control levers 36 to open and close hydraulic valves to control the flow of hydraulic fluid through hydraulic lines 40, 42 and ultimately to and from upper head clamp assembly 24 and lower head clamp assembly 26. As such, all aspects of the movement of various components and operation of CPTSS 10 described herein may be controlled manually by CPTSS operator at operator's platform 55.

In some embodiments, operation of CPTSS 10 may be autonomous. In automatic mode operation of CPTSS 10, a controller may detect various states of the system and control hydraulic valves in operation of hydraulic network 34. Autonomous control of hydraulic network 34 may be performed by stored computer-executable instructions executable by at least one processor as described in detail below. Hydraulic valves may be, or may be actuated by, electromechanical actuators that may be controlled by an operator utilizing a remote-control device in communication with the at least one processor for controlling the hydraulic valves. Furthermore, in some embodiments, the at least one processor may comprise at least one controller (e.g., linear, nonlinear, adaptive, machine learning, or the like) for controlling the hydraulic valves. As such, any operation of CPTSS 10 described herein may be performed directly by CPTSS operator manipulating the hydraulic valves, operating a remote control in communication with actuators controlling hydraulic valves, and/or automatically by the at least one controller.

In some embodiments, the power source for operation may be positioned on CPTSS 10 and/or may be provided by excavator 12. Electrical, pneumatic, and/or hydraulic power to operate components of CPTSS 10 may be provided by batteries and/or an engine associated with and/or positioned at excavator 12. Furthermore, in the case of batteries positioned at CPTSS 10 and/or excavator 12, the batteries may be charged by an alternator associated with an engine of excavator 12 or may be charged by other sustainable energy methods such as solar cells or wind energy turbines in the field. Further still, operation of CPTSS 10 may be powered directly by the alternator or battery source of the excavator engine and/or by the hydraulic system of excavator 12.

In some embodiments, CPTSS 10 may include gauges 38, as shown in FIG. 4, communicatively connected to pressure sensors of sounding cone penetrometer 60 and/or any components of CPTSS 10 and hydraulic network 34. The gauges 38 may receive input from the user to perform pressure readings during the process of operation or may automatically display pressure throughout hydraulic network 34 such that CPTSS operator may always track pressures in the system in real time. CPTSS 10 may also include electrical connections, hydraulic components, and data acquisition system (DAS) 88 (FIG. 7) described in detail below. Gauges 38 may comprise a primary clamp bottom pressure, CPTSS pressure, and primary clamp bottom pressure. The range of pressures for primary clamp top (upper clamp 90) and primary clamp bottom (lower clamp assembly, not shown) may vary from a range of 0-3,000 pounds per square inch; though these pressures are exemplary and CPTSS 10 may be configured for any size and any pressures.

Continuing with the exemplary embodiment depicted in FIG. 4, hydraulic network 34 may comprise hydraulic control levers 36 connected to hydraulic valves of hydraulic lines 40, 42, and gauges 38. In some embodiments, hydraulic control levers 36 may comprise various levers for opening and closing the various valves to control the clamps and the cylinders of upper head clamp assembly 24 and lower head clamp assembly 26. The gauges corresponding to each hydraulic line may present the corresponding pressure. For example, a gauge corresponding to upper clamp assembly may read +/−3000 psi, using the example from above, and the corresponding clamp may be fully engaged, or disengaged and reading at 0 psi. Furthermore, hydraulic control levers 36 may comprise push/pull levers to control the operation of upper hydraulic cylinders 48*a*, 48*b*, and lower hydraulic cylinders 54*a*, 54*b*, to push rod string 28 into the ground.

Figure 5:
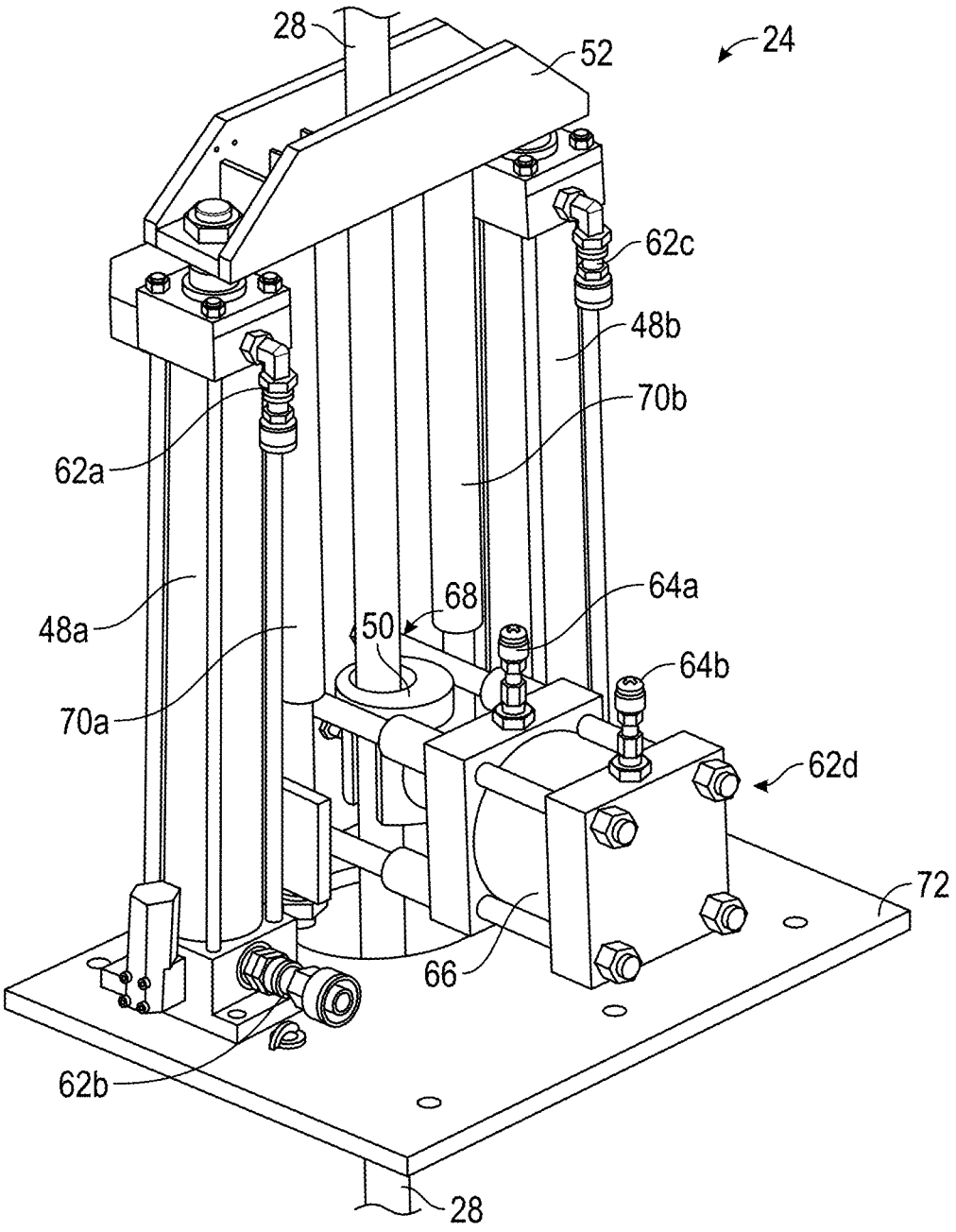
FIG. 5 depicts an exemplary embodiment of upper head clamp assembly.

FIG. 5 depicts an embodiment of upper head clamp assembly 24. Though upper head clamp assembly 24 is illustrated, it can be imagined that lower head clamp assembly 26 comprises the same components and operates similarly. It can be imagined that lower head clamp assembly 26 is the same as upper head clamp assembly 24 but simply placed lower but is operated the same. A description of upper head clamp assembly 24 and lower head clamp assembly 26 operating in conjunction is described in detail below and illustrated in FIGS. 6A and 6B. Here, upper head clamp assembly 24 comprises upper head bracket 52, upper hydraulic cylinders 48*a*, 48*b*, upper hydraulic connectors 62*a*, 62*b*, 62*c*, 62*d* (behind upper actuator 50), upper actuator 50, actuator hydraulic connectors 64*a*, 64*b*, upper clamp assembly 68 (shown in more detail in FIGS. 8A and 8B), and upper platform 72.

Figure 6A:
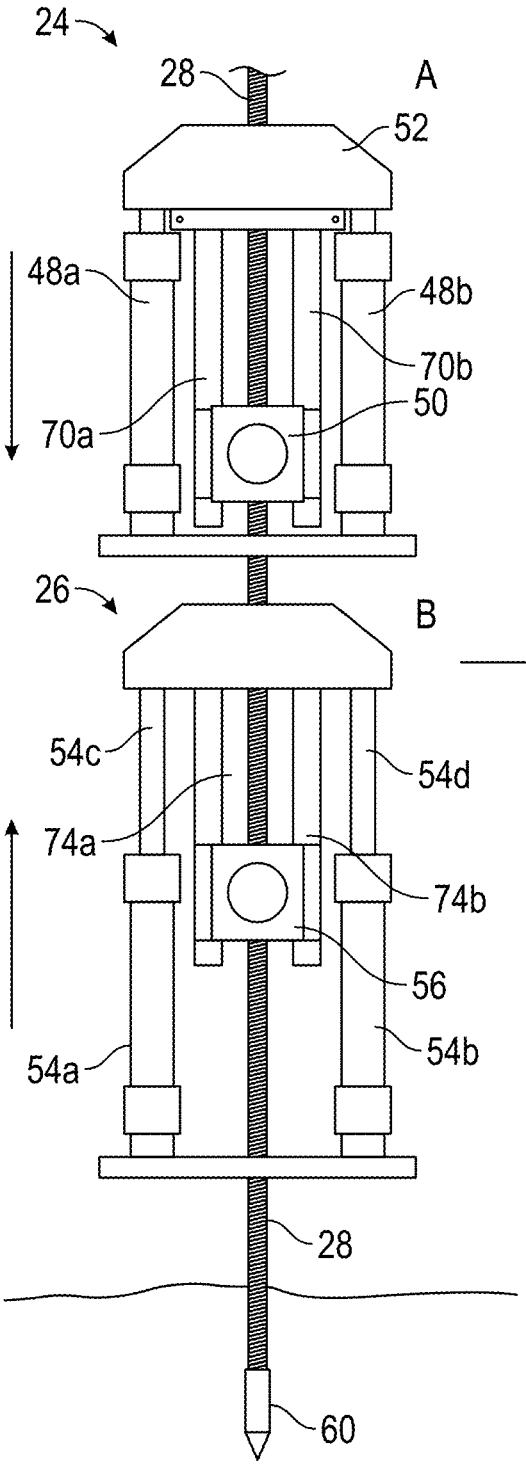
FIGS. 6A and 6B depict an exemplary embodiment illustrating operation of stacked head clamp assemblies of the CPTSS.
Figure 6B:
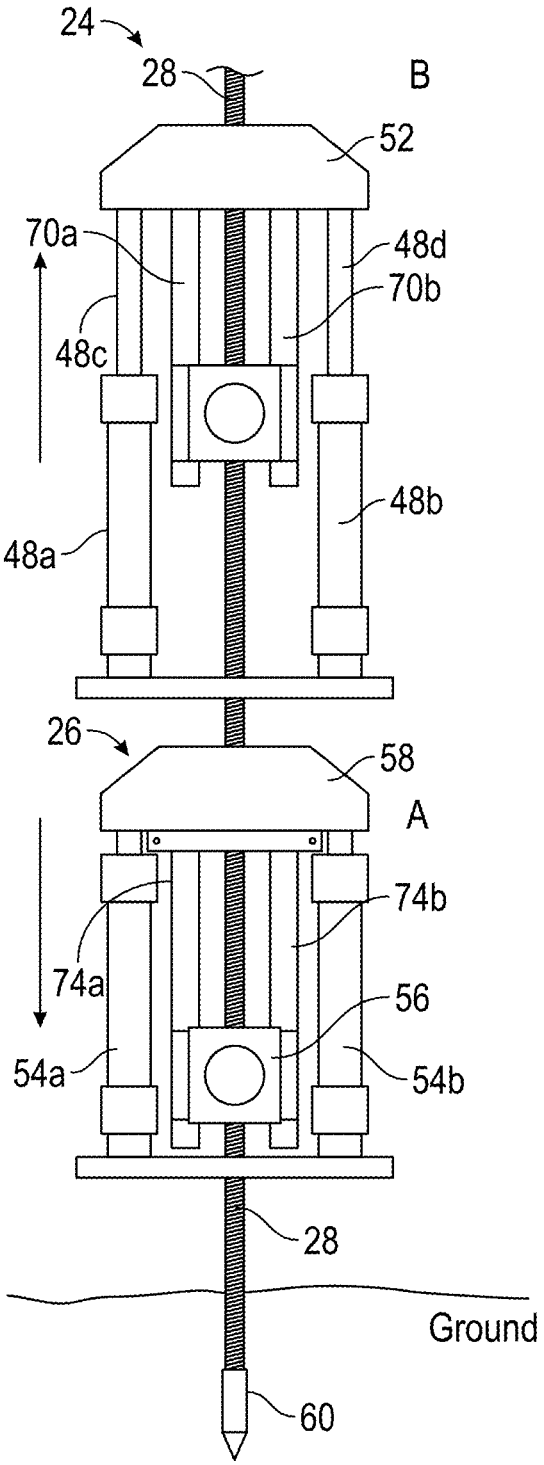

In some embodiments, upper head bracket 52 is coupled to upper hydraulic cylinders 48*a*, 48*b*, by upper hydraulic rods 48*c*, 48*d* (FIGS. 6A and 6B). Therefore, when hydraulic energy is provided to upper hydraulic connectors 62*a*, 62*b*, 62*c*, 62*d*, upper hydraulic cylinders 48*a*, 48*b* are actuated to extend or retract. Upper hydraulic rods 48*c*, 48*d* may be coupled to upper head bracket 52 and head bracket 52 may be coupled to actuator support arms 70*a*, 70*b* such that when upper hydraulic rods 48*c*, 48*d* are extended, upper actuator 50 and upper clamp assembly 68 move up and down depending on the motion of upper hydraulic rods 48*c*, 48*d* based on the direction of flow of the hydraulic fluid in hydraulic lines 42 of hydraulic network 34.

Furthermore, when hydraulic energy is provided to actuator 50 by actuator hydraulic connectors 64*a*, 64*b*, upper clamp assembly 68 may be actuated to engage or release rod string 28. Therefore, upper clamp assembly 68 may engage rod string 28 then upper clamp assembly 68 may be moved downward toward the ground forcing rod string 28 in a downward direction. Furthermore, upper clamp assembly 68 may be disengaged from rod string 28 and be forced upward by hydraulic energy provided to upper hydraulic connectors 62*a*, 62*b*, 62*c*, 62*d*. Accordingly, upper clamp assembly 68 may move upward without moving rod string 28 or vise verse.

Figure 7:
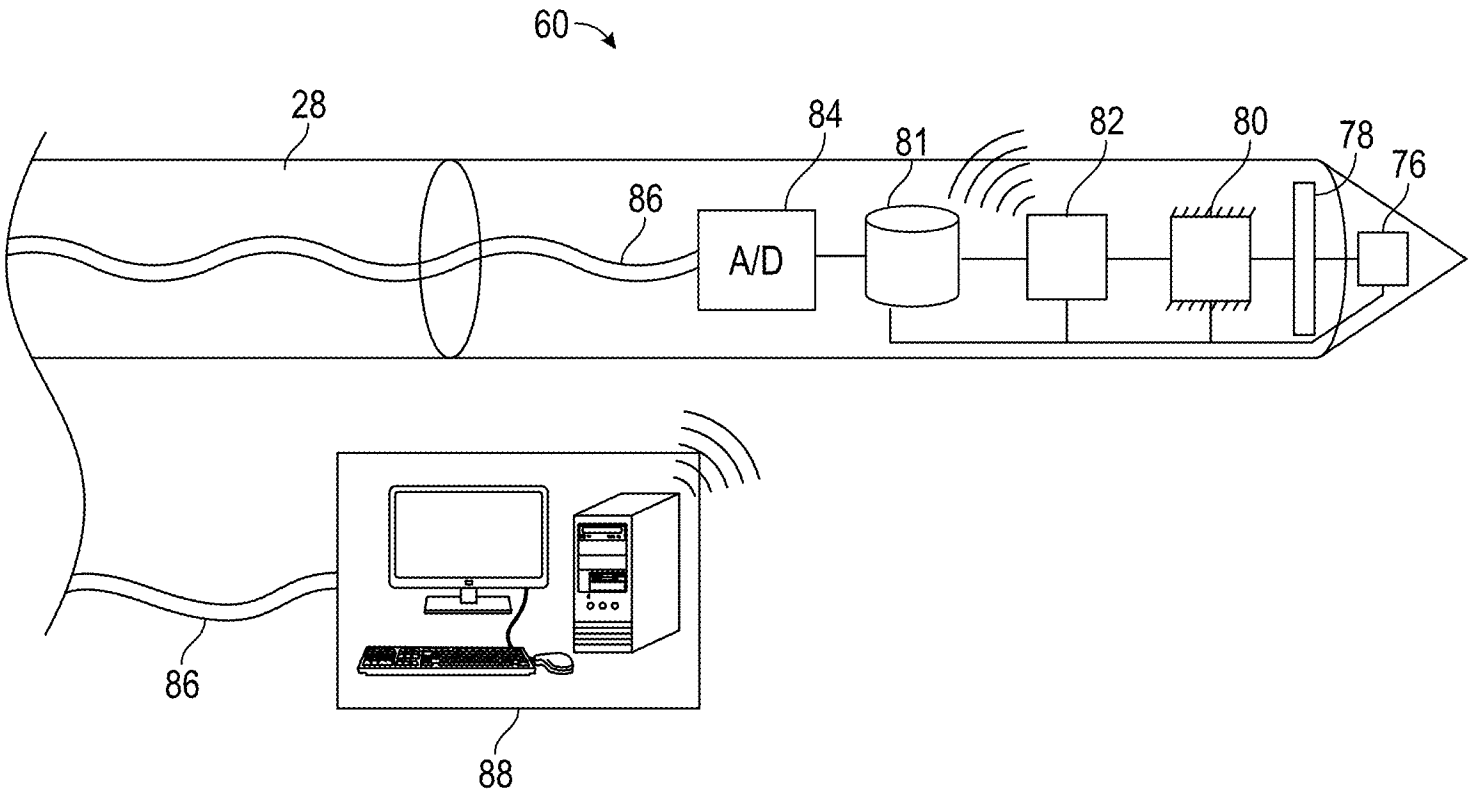
FIG. 7 depicts an exemplary sounding cone penetrometer for some embodiments.

FIGS. 6A and 6B, depict upper head clamp assembly 24 and lower head clamp assembly 26 working in coordination to press rod string 28 and sounding cone penetrometer 60 into the ground for soil testing. In some embodiments, upper head clamp assembly 24 may be operable to clamp onto rod string 28 using actuator 50 comprising upper clamp assembly 68. Then, under hydraulic power from hydraulic network 34 upper head clamp assembly 24 may be forced downward toward the ground pressing rod string 28 into the ground. At the same time, lower head clamp assembly 26 may be forced upward by hydraulic power while not engaged with rod string 28. Lower clamp assembly 56 may be connected to lower support rods 74*a*, 74*b*, which may be connected to lower head mount 58. When a lower limit of upper head clamp assembly 24 is reached, actuator 50 may be actuated to release upper clamp assembly 68 from rod string 28. Similarly, or alternatively, as an upper limit of lower head clamp assembly 26 is reached, lower actuator of lower clamp assembly 56 may be actuated to engage rod string 28. At this point in the process, upper head clamp assembly 24 is at its lowest point and disengaged from rod string 28 and lower head clamp assembly 26 is at its highest point and the lower clamps are engaged with rod string 28. Hydraulic energy from hydraulic network 34 may shift by manual operation or automatically to reverse the process. In some embodiments, lower head clamp assembly 26 may move downward pressing rod string 28 into the ground while upper head clamp assembly 24 moves upward back to its initial position. When an upper limit of upper head clamp assembly 24 is reached, upper clamp assembly 68 may be actuated to engage rod string 28 once again. Similarly, or alternatively, lower head clamp assembly 26 may reach a lower limit and the lower clamps may disengage from rod string 28. Now, upper head clamp assembly 24 and lower head clamp assembly 26 may be again at the initial configuration set to continue pressing rod string 28 and sounding cone penetrometer 60 into the soil. The movements of upper head clamp assembly 24 and lower head clamp assembly 26 may repeat until the cone penetrometer sounding test is complete, anomalies a detected, or CPTSS operator stops the process. FIG. 7 depicts an embodiment of sounding cone penetrometer 60. In some embodiments, sounding cone penetrometer 60 may be coupled to the end of rod string 28 proximate the ground for penetrating the ground for soil testing. As such, sounding cone penetrometer 60 may be configured with sensors for testing the soil. Sounding cone penetrometer 60 may be configured with one of a triangular tip, square top, oval tip, cone tip, or any tip shape for performing the necessary soil penetration described herein. Furthermore, the tip of sounding cone penetrometer 60 may be configured with tip sensors 76 as well as additional sensors 78. For example, compression and tension mandrels may be disposed on the interior side of the tip of sounding cone penetrometer 60. Tip sensors 76 may detect the forces required to press into the soil which may be utilized along with the dimensions of sounding cone penetrometer 60 along with a geometry of various components of CPTSS 10 and associated modeled noise to determine soil characteristics such as, for example, density, soil type, moisture, speed, location, and the like. Sounding cone penetrometer 60 may be used to identify soil types such as sandy fill, loamy, bay mud, mud, and sand, as well as others assess the bearing capacity of foundations, assess liquefaction susceptibility, determine hydraulic conductivity and hydraulic permeability, to determine soil stratification, as well as many other uses.

In some embodiments, sounding cone penetrometer 60 may house additional sensors 78 such as, for example, pressure sensors, pore moisture sensors, accelerometers, pressure transducers, strain gauges, GPS sensors, and the like. These additional sensors 78 may provide data indicative of characteristics of the soil and may be used along with other characteristics of CPTSS 10 as described above. Furthermore, in some embodiments, sounding cone penetrometer 60 may comprise cone penetrometer processors 80, cone memory 81 configured to store data and computer-readable instructions configured to obtain, store, and transmit data as well as calculate parameters from the obtained and stored data at cone memory 81. Some parameters that may be stored at cone memory 81, and measured by the various cone sensors include tip resistance, sleeve frication in-situ pore pressure, soil behavior type, hydraulic pressure, hydraulic motor parameters, location, relative locations of components of CPTSS 10, and the like. Furthermore, in some embodiments, data may be transmitted to DAS 88 by wireless communication device 82, which may transmit by close-range communication.

Figure 10:
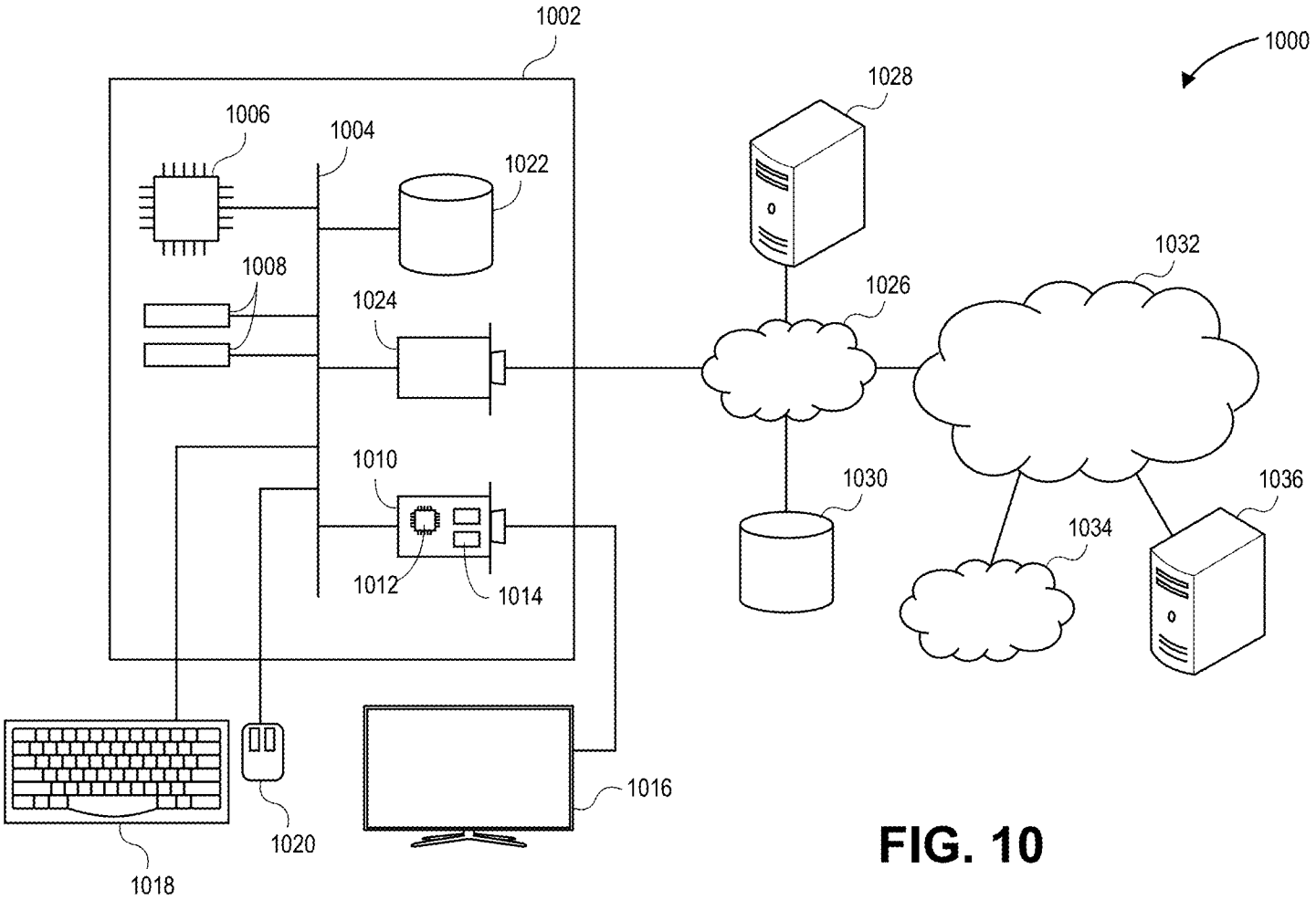
FIG. 10 depicts an exemplary hardware platform for some embodiments of the disclosure.

In some embodiments, CPTSS 10 may comprise DAS 88 including cable 86 and may be incorporated into hardware platform 1000 (FIG. 10). DAS 88 may be in communication with sounding cone penetrometer 60. In some embodiments, DAS 88 may comprise computer-executable instructions configured to process data from the various sensors of sounding cone penetrometer 60 and cause display of soil stratigraphy and in-situ measurements. For example, during testing, an advance rate of the sounding cone penetrometer 60, tip stress, sleeve friction, pore water pressure, acidity, magnetic properties (for detection of metals), orientation (e.g., X-inclination, Y-inclination), temperature, reduction potential, radioisotopes, and any other parameter can be measured, processed, and displayed at any display associated with, and/or in communication with CPTSS 10. In some embodiments, analog-to-digital converter 84 may be provided in sounding cone penetrometer 60 such that the data may be converted to digital before transmitting to CPTSS processors at hardware platform 1000.

In some embodiments, DAS 88 may utilize wireless communication transmitters of hardware platform 1000, which may be disposed anywhere on frame 22. DAS 88 may provide real-time display of sensor data to the CPTSS operator on operator's platform 55, inside a cab of excavator 12, and/or at a remote location.

Figure 8A:
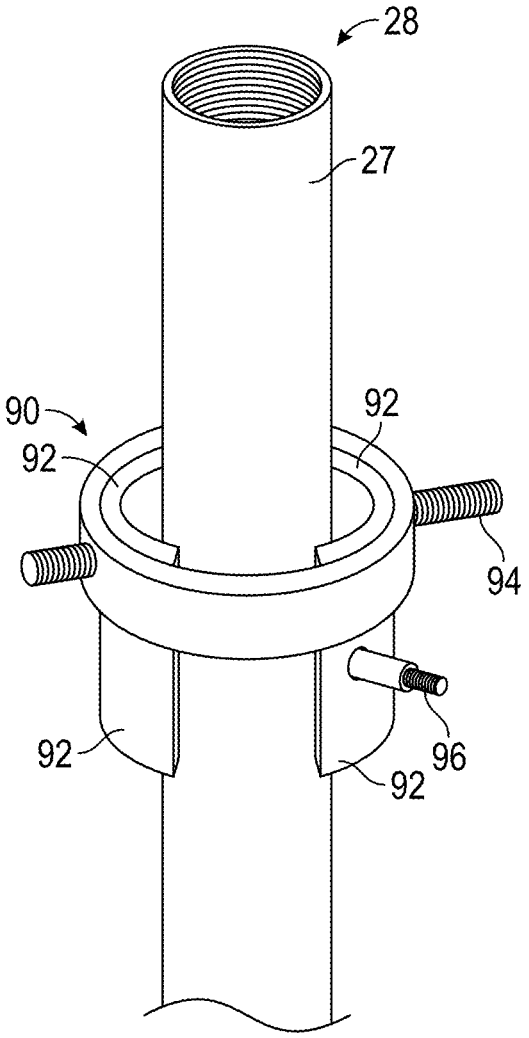
FIGS. 8A and 8B depict exemplary clamp assemblies of head clamp assemblies for embodiment.
Figure 8B:
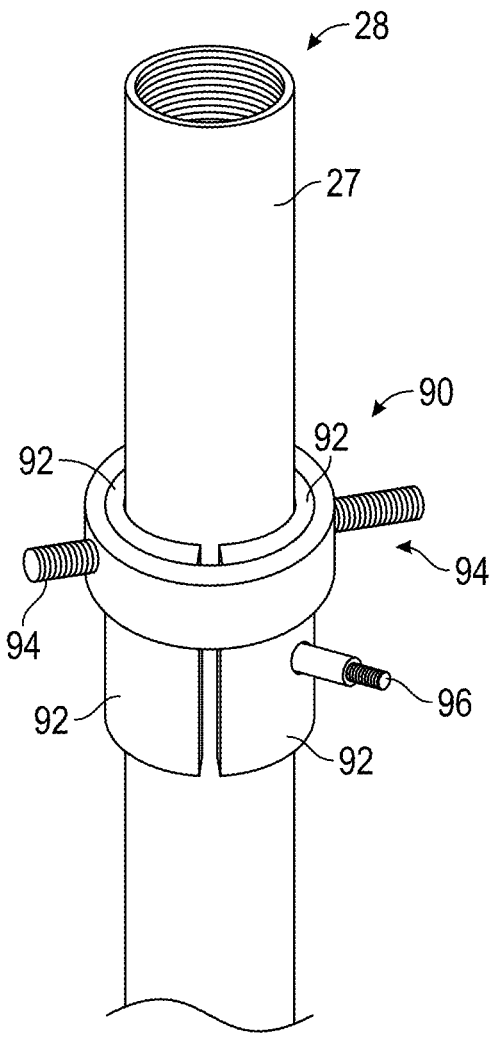

FIGS. 8A and 8B depict an embodiment of upper clamp assembly disengaged with rod (FIG. 8A) and engaged with rod (FIG. 8B). In some embodiments, upper clamp ring 94 may be coupled to upper clamp assembly 68 that may be coupled to upper platform 72 and/or actuator support arms 70*a*, 70*b*. As energy is provided by hydraulic network 34, upper clamp assembly 68 may comprise actuator 50 and hydraulic piston 66. Hydraulic energy may be provided to actuator 50 and engage upper clamp 90 by connector 96 and upper clamp ring 94 may rotate or press inward pressing clamp pads 92 into contact with rod string 28. This action causes movement of upper clamp 90 from the disengaged configuration (FIG. 8A) to the engaged configuration (FIG. 8B). As such, the pressure applied to rod 27 by upper clamp assembly 68 may result in such a high friction that rod string 28 may be pressed into the soil for soil testing. In some embodiments, the friction may be increased based on upper clamp assembly 68 and clamp pads 92 that may be positioned to engage rod 27. Clamp pads 92 may comprise a highly durable and high friction and high surface area material such as, for example, rubber.

Figure 9:
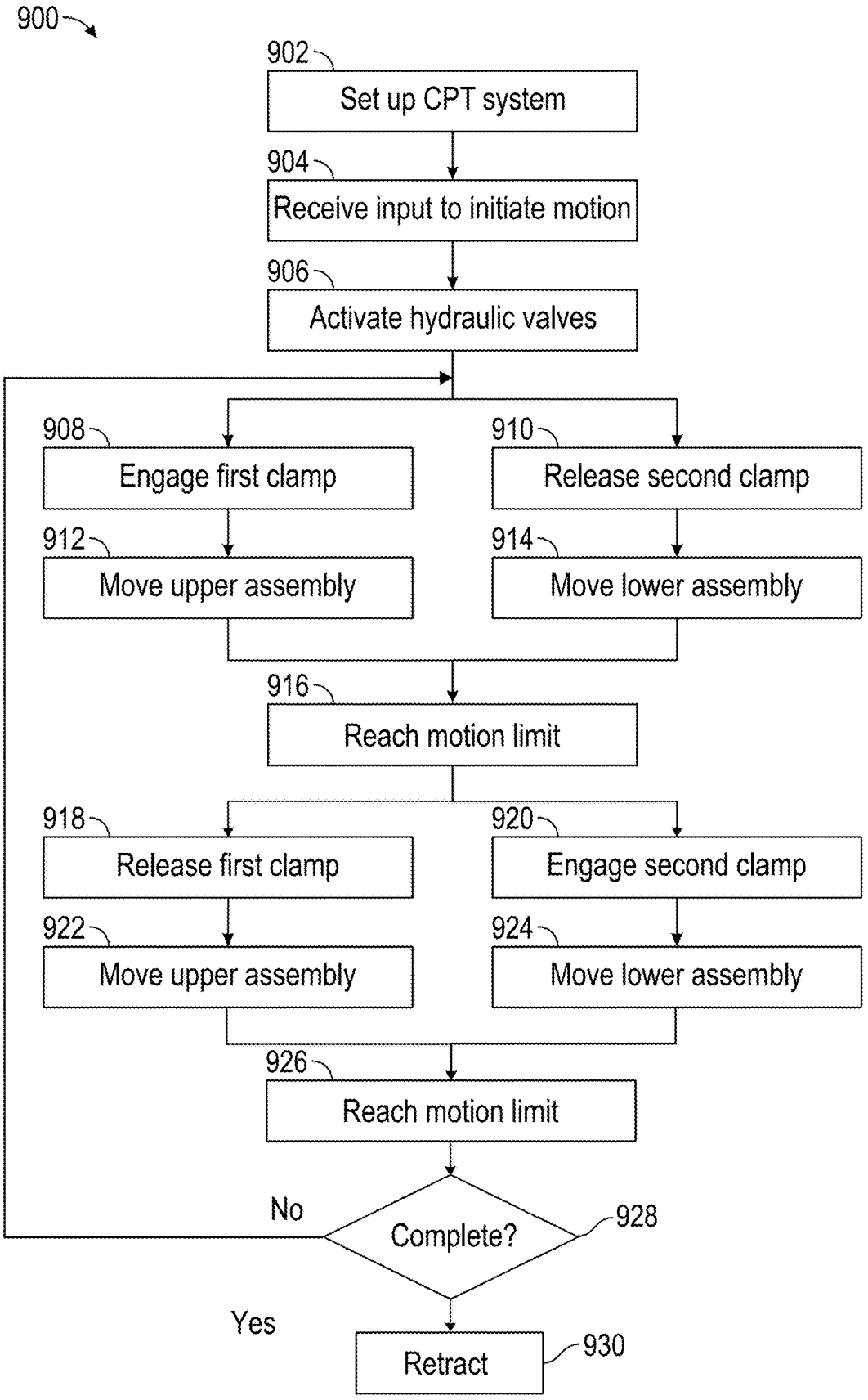
FIG. 9 depicts an exemplary process of testing soil by the CPTSS.

FIG. 9 depicts a flow chart 900 illustrating an exemplary process of operation of CPTSS 10. At step 902, CPTSS 10 is set up for operation. As described in embodiments above, CPTSS 10 may be positioned horizontally on footings 16 for ease of access of some locations and some components of CPTSS 10. In the horizontal and/or the vertical configuration depicted in FIGS. 1 and 2, operators may check all systems, add rods 27 to rod string 28, insert rod string 28 through upper head clamp assembly 24 and lower head clamp assembly 26 through upper clamp assembly 68 and lower clamp assembly, activate electric, hydraulic, and/or pneumatic energy and the like. Furthermore, any tests may be run to make ensure that all components of CPTSS 10 are in working order and that CPTSS 10 is ready for operation. In some embodiments, step 902 includes moving CPTSS 10 to a location for testing. As such, excavator 12 may be operated to move CPTSS 10 to the testing site prior to the operation testing and rod loading described above.

At step 904, input to initiate activation of CPTSS 10 to begin operation may be received. Inputs may be received at CPTSS 10 and/or by a remote computer that may be nearby communicating by short-range communication methods such as WiFi or BLUETOOTH, and/or CPTSS 10 may communicate with the computer 1036 online at a remote server as described in detail below and illustrated in FIG. 10. The input may be provided by CPTSS operator to initiate an automated sequence, a partially automated sequence, or the CPTSS operator may manually control CPTSS 10 throughout operation using hydraulic control levers 36.

Generally, operation of CPTSS 10 to insert sounding cone penetrometer 60 and rod string 28 into the ground is performed by hydraulic network 34 providing energy to upper head clamp assembly 24 and lower head clamp assembly 26 at step 906. In some embodiments, central processing unit 1006 (FIG. 10), or controller, may be configured to actuate the valves of hydraulic network 34 to perform automated operations of CPTSS 10. In some scenarios, the CPTSS operator may initiate operation and all processes described below may be performed completely autonomously. In other scenarios, processes may be manually operated by CPTSS operator manually actuating the hydraulic control levers 36 while some processes are automatic. For example, the CPTSS operator may initiate operation and manually control the hydraulic control levers 36 of CPTSS 10 to insert sounding cone penetrometer 60 into the ground. The CPTSS operator may view display 1016 showing the in-situ output from tip sensors 76 and additional sensors 78 of sounding cone penetrometer 60 such that the CPTSS operator can evaluate the soil and operation in real time. The CPTSS operator may stop at any time and initiate automated mode where the processes performed below are carried out autonomously. Any operations may be performed by any CPTSS operator on site or remotely or performed entirely by the controller utilizing feedback from the cone penetrometer sensors and various sensors on CPTSS 10.

At step 908, in some embodiments, the first clamp may be engaged to clamp a rod of rod string 28. The first clamp may be upper clamp assembly 68 or lower clamp assembly depending on the starting position of upper head clamp assembly 24 and lower head clamp assembly 26. Whichever clamp is at the height of its stroke may be the clamp to engage rod string 28. Here, we will assume, as described above, that upper head clamp assembly 24 is at the top of its stroke. Therefore, at step 908, upper clamp assembly 68 may be actuated to engage rod string 28. Actuation of clamp pads 92 may be performed by applying hydraulic energy to upper clamp assembly 68 comprising actuator 50. Actuator 50 may rotate, forcing clamp pads 92 in contact with rod string 28.

At step 910, approximately simultaneously with step 908, the lower clamp assembly 56 (e.g., second clamp) may be actuated to release rod string 28. Initially, lower clamp assembly 56 may already be disengaged with rod string 28; however, if lower clamp assembly 56 is engaged, it may be actuated by hydraulic network 34 to be released.

At step 912, upper head clamp assembly 24 may be actuated under hydraulic energy to force rod string 28 including sounding cone penetrometer 60 into the ground. As described above, hydraulic network 34 may force upper hydraulic rods 48*c* and 48*d* to retract moving upper head clamp assembly 24 including upper clamp assembly 68 downward forcing rod string 28 into the ground. This action pushes sounding cone penetrometer 60 disposed on the end of rod string 28 deeper into the ground while taking measurements of the soil characteristics described above.

At step 914, approximately simultaneously to step 912, lower head clamp assembly 26 may be moved upward. As described above, hydraulic network 34 may force lower hydraulic cylinders 54*c* and 54*d* to extend forcing lower head clamp assembly 26 including lower clamp assembly 56 upward. At this point lower clamp assembly 56 is not engaged with rod string 28 and may move upward without impacting rod string 28.

At step 916, upper head clamp assembly 24 may reach a lower limit (lower stroke end) while lower head clamp assembly 26 may reach an upper limit (upper stroke end). As each head clamp assembly reaches its limit, the process moves to steps 918 and 920.

At step 918, upper clamp assembly 68 may be disengaged when upper head clamp assembly 24 reaches the end of the downward stroke. Approximately simultaneously, or slightly before upper clamp assembly 68 is disengaged, at step 920, lower clamp assembly 56 may be engaged when lower head clamp assembly 26 reaches the end of the upward stroke.

At step 922, with upper clamp assembly 68 disengaged, upper head clamp assembly 24 may be moved upward back to its starting position illustrated at step 912. Furthermore, nearly simultaneously to step 922, at step 924, with lower clamp assembly 56 engaged, lower head clamp assembly 26 may be moved downward pressing rod string 28 further into the ground while sounding cone penetrometer 60 measures the soil characteristics described above.

At step 926, upper head clamp assembly 24 may reach a higher limit (upper stroke end) while lower head clamp assembly 26 may reach a lower limit (lower stroke end). As each head clamp assembly reaches its limit, the process moves to steps 930.

At step 928, and throughout the process, it is determined if the process is complete. The process may be complete when sounding cone penetrometer 60 has reached a predefined depth, the data collected indicates that the process is complete, an anomaly (e.g., dense material, unsuitable material, damaged equipment or the like) is determined, and/or the CPTSS operator ends the process.

In some embodiments, at step 930, when the insertion process and data collection is complete, extraction of rod string 28 and sounding cone penetrometer 60 may be performed simply by reversing the operation of upper head clamp assembly 24 and lower head clamp assembly 26. For example, upper clamp assembly 68 may be engaged with rod string 28 and actuated to move upward extracting rod string 28. As upper head clamp assembly 24 reaches the maximum stroke, upper clamp assembly 68 may be actuated to disengage rod string 28 while lower clamp assembly 56 may be actuated to engage rod string 28. Lower head clamp assembly 26 may be actuated to move upward continuing to retract rod string 28 from the ground while upper head clamp assembly 24 is actuated to move downward to the lower stroke limit. This process may be repeated until rod string 28 and sounding cone penetrometer 60 are fully removed from the ground.

In some embodiments, an auxiliary clamp may be used to clamp and hold rod string 28 while both upper clamp assembly 68 and lower clamp assembly 56 are disengaged. Auxiliary clamp may be located at any point along CPTSS 10 including, but not limited to, above upper head clamp assembly 24, between upper head clamp assembly 24 and lower head clamp assembly 26, or below lower head clamp assembly 26.

In some embodiments, hardware platform 1000 comprises DAS 88 as shown in FIG. 7. FIG. 10 depicts exemplary hardware platform 1000 for certain embodiments of the invention. Computer 1002 can be a desktop computer, a laptop computer, a server computer, a mobile device such as a smartphone or tablet, or any other form factor of general- or special-purpose computing device. Depicted with computer 1002 are several components, for illustrative purposes. In some embodiments, certain components may be arranged differently or absent. Additional components may also be present. Included in computer 1002 is system bus 1004, whereby other components of computer 1002 can communicate with each other. In certain embodiments, there may be multiple busses or components may communicate with each other directly. Connected to system bus 1004 is central processing unit (CPU) 1006. Also attached to system bus 1004 are one or more random-access memory (RAM) modules 1008. Also attached to system bus 1004 is graphics card 1010. In some embodiments, graphics card 1010 may not be a physically separate card, but rather may be integrated into the motherboard or the CPU 1006. In some embodiments, graphics card 1010 has a separate graphics-processing unit (GPU) 1012, which can be used for graphics processing or for general purpose computing (GPGPU). Also on graphics card 1010 is GPU memory 1014. Connected (directly or indirectly) to graphics card 1010 is display 1016 for user interaction. In some embodiments no display is present, while in others it is integrated into computer 1002. Similarly, peripherals such as keyboard 1018 and mouse 1020 are connected to system bus 1004. Like display 1016, these peripherals may be integrated into computer 1002 or absent. Also connected to system bus 1004 is local storage 1022, which may be any form of computer-readable media and may be internally installed in computer 1002 or externally and removably attached.

Computer-readable media include both volatile and nonvolatile media, removable and nonremovable media, and contemplate media readable by a database. For example, computer-readable media include (but are not limited to) RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data temporarily or permanently. However, unless explicitly specified otherwise, the term "computer-readable media" should not be construed to include physical, but transitory, forms of signal transmission such as radio broadcasts, electrical signals through a wire, or light pulses through a fiber-optic cable. Examples of stored information include computer-useable instructions, data structures, program modules, and other data representations.

Finally, network interface card (NIC) 1024 is also attached to system bus 1004 and allows computer 1002 to communicate over a network such as local network 1026. NIC 1024 can be any form of network interface known in the art, such as Ethernet, ATM, fiber, Bluetooth®, or Wi-Fi (i.e., the IEEE 802.11 family of standards). NIC 1024 connects computer 1002 to local network 1026, which may also include one or more other computers, such as computer 1028, and network storage, such as data store 1030. Generally, a data store such as data store 1030 may be any repository from which information can be stored and retrieved as needed. Examples of data stores include relational or object-oriented databases, spreadsheets, file systems, flat files, directory services such as LDAP and Active Directory, or email storage systems. A data store may be accessible via a complex API (such as, for example, Structured Query Language), a simple API providing only read, write and seek operations, or any level of complexity in between. Some data stores may additionally provide management functions for data sets stored therein such as backup or versioning. Data stores can be local to a single computer such as computer 1028, accessible on a local network such as local network 126, or remotely accessible over Internet 1032. Local network 1026 is in turn connected to Internet 1032, which connects many networks such as local network 1026, remote network 1034 or directly attached computers such as computer 1036. In some embodiments, computer 1002 can itself be directly connected to Internet 1032.

In some aspects, the techniques described herein relate to a cone penetrometer testing sounding system for testing ground soil, including a rod string including a plurality of connected rods; an upper head clamp assembly including at least one upper clamp configured to selectively engage the rod string, a lower head clamp assembly including at least one lower clamp configured to selectively engage the rod string, wherein the upper head clamp assembly and the lower head clamp assembly are positioned in a vertical configuration with the upper head clamp assembly above the lower head clamp assembly, a cone penetrometer including at least one sensor configured to detect ground soil characteristics, wherein the cone penetrometer is configured to be coupled to a ground penetrating end of the rod string, a hydraulic network configured to supply hydraulic power to the upper head clamp assembly and the lower head clamp assembly, wherein, under a first force applied by the hydraulic network, the at least one upper clamp is configured to engage the rod string, wherein, under a second force applied by the hydraulic network, the at least one lower clamp is configured to disengage the rod string, wherein, under a third force applied by the hydraulic network, the upper head clamp assembly is configured to move downward forcing the cone penetrometer into the ground soil, and wherein, under a fourth force applied by the hydraulic network, the lower head clamp assembly is configured to move upward away from the ground soil.

In some aspects, the techniques described herein relate to a cone penetrometer testing sounding system, wherein, under a fifth force applied by the hydraulic network, the at least one upper clamp is configured to release the rod string, wherein, under a sixth force applied by the hydraulic network, the at least one lower clamp is configured to engage the rod string, wherein, under a seventh force applied by the hydraulic network, the upper head clamp assembly is configured to move upward away from the ground soil back to a starting position, and wherein, under an eighth force applied by the hydraulic network, the lower head clamp assembly is configured to move downward forcing the rod string farther into the ground soil.

In some aspects, the techniques described herein relate to a cone penetrometer testing sounding system, wherein the at least one sensor is a plurality of sensors configured to detect soil resistance, pore pressure, soil behavior, acidity, temperature, and moisture.

In some aspects, the techniques described herein relate to a cone penetrometer testing sounding system, further including: a platform for an operator to be positioned while operating the cone penetrometer testing sounding system; and a set of valve controls for the operator to control motion of the upper head clamp assembly and the lower head clamp assembly.

In some aspects, the techniques described herein relate to a cone penetrometer testing sounding system, wherein the hydraulic network is coupled to a machine hydraulic network of an auxiliary machine.

In some aspects, the techniques described herein relate to a cone penetrometer testing sounding system, wherein the auxiliary machine is an excavator.

In some aspects, the techniques described herein relate to a cone penetrometer testing sounding system, further including a frame configured to couple to a boom of the excavator, wherein the frame is configured to support all components of the cone penetrometer testing sounding system and be lifted by the excavator.

In some aspects, the techniques described herein relate to a cone penetrometer testing sounding system for testing ground soil, including a rod string including a plurality of connected rods; an upper head clamp assembly including at least one upper clamp configured to selectively engage the rod string; a lower head clamp assembly including at least one lower clamp configured to selectively engage the rod string, wherein the upper head clamp assembly and the lower head clamp assembly are positioned with the upper head clamp assembly above the lower head clamp assembly in a vertical configuration, a cone penetrometer including at least one sensor configured to detect ground soil characteristics, wherein the cone penetrometer is configured to be coupled to a ground penetrating end of the rod string; a power source configured to supply power to the upper head clamp assembly and the lower head clamp assembly, wherein the at least one upper clamp is configured to selectively engage the rod string, wherein the at least one lower clamp is configured to selectively engage the rod string, wherein the upper head clamp assembly is configured to selectively move up and down forcing the cone penetrometer into the ground soil on a upper head clamp assembly downward stroke, and wherein the lower head clamp assembly is configured to selectively move up and down forcing the cone penetrometer into the ground soil on a lower head clamp assembly downward stroke.

In some aspects, the techniques described herein relate to a cone penetrometer testing sounding system, further including a frame configured to support all components of the cone penetrometer testing sounding system.

In some aspects, the techniques described herein relate to a cone penetrometer testing sounding system, wherein the frame is further configured with footings to support the cone penetrometer testing sounding system in a horizontal position.

In some aspects, the techniques described herein relate to a cone penetrometer testing sounding system, further including at least one processor configured to control the power source to apply the power to the upper head clamp assembly and the lower head clamp assembly.

In some aspects, the techniques described herein relate to a cone penetrometer testing sounding system, wherein the control of the upper head clamp assembly and the lower head clamp assembly is based on data output of the at least one sensor.

In some aspects, the techniques described herein relate to a cone penetrometer testing sounding system, wherein the power source is a hydraulic motor.

In some aspects, the techniques described herein relate to a method of testing ground soil by a cone penetrometer testing sounding system, the method including providing an upper head clamp assembly including an upper clamp assembly; providing a lower head clamp assembly including a lower clamp assembly, providing a power source to a hydraulic network, wherein the hydraulic network is in fluid communication with the upper head clamp assembly, the upper clamp assembly, the lower head clamp assembly, and the lower clamp assembly, actuating the upper clamp assembly to engage a rod string, actuating the lower clamp assembly to disengage the rod string; actuating the upper head clamp assembly to move downward pressing the rod string into the ground soil, wherein the rod string includes a cone penetrometer including at least one sensor detecting a state of the ground soil, actuating the lower head clamp assembly to move upward away from the ground soil, and obtaining and storing an output of the at least one sensor.

In some aspects, the techniques described herein relate to a method, wherein the at least one sensor is a plurality of sensors configured to detect soil resistance, pore pressure, soil behavior, acidity temperature, and moisture.

In some aspects, the techniques described herein relate to a method, further including controlling the hydraulic network by an operator providing inputs by a set of valve controls.

In some aspects, the techniques described herein relate to a method, further including controlling the hydraulic network by at least one processor based on the output of the at least one sensor.

In some aspects, the techniques described herein relate to a method, further including transmitting the output from the at least one sensor to at least one processor, and causing display of the output by a display monitor associated with the at least one processor.

In some aspects, the techniques described herein relate to a method, further including providing a frame configured to support all components of the cone penetrometer testing sounding system and configured with footings to support the cone penetrometer testing sounding system in a horizontal position.

In some aspects, the techniques described herein relate to a method, wherein the at least one sensor includes an accelerometer, a strain gauge, a thermometer, a magnetometer, and a pH meter.

Although the invention has been described with reference to the embodiments illustrated in the attached drawing figures, it is noted that equivalents may be employed, and substitutions made herein without departing from the scope of the invention.

Having thus described various embodiments, what is claimed as new and desired to be protected by Letters Patent includes the following:

1. A cone penetrometer testing sounding system for testing ground soil, comprising:

a rod string comprising a plurality of connected rods;

an upper head clamp assembly comprising at least one upper clamp configured to selectively engage the rod string;

a lower head clamp assembly comprising at least one lower clamp configured to selectively engage the rod string, wherein the upper head clamp assembly and the lower head clamp assembly are positioned in a vertical configuration with the upper head clamp assembly above the lower head clamp assembly;

a cone penetrometer comprising at least one sensor configured to detect ground soil characteristics, wherein the cone penetrometer is configured to be coupled to a ground penetrating end of the rod string;

a hydraulic network configured to supply hydraulic power to the upper head clamp assembly and the lower head clamp assembly;

wherein, under a first force applied by the hydraulic network, the at least one upper clamp is configured to engage the rod string, wherein, under a second force applied by the hydraulic network, the at least one lower clamp is configured to disengage the rod string, wherein, under a third force applied by the hydraulic network, the upper head clamp assembly is configured to move downward forcing the cone penetrometer into the ground soil, and wherein, under a fourth force applied by the hydraulic network, the lower head clamp assembly is configured to move upward away from the ground soil.

2. The cone penetrometer testing sounding system of claim 1, wherein, under a fifth force applied by the hydraulic network, the at least one upper clamp is configured to release the rod string, wherein, under a sixth force applied by the hydraulic network, the at least one lower clamp is configured to engage the rod string, wherein, under a seventh force applied by the hydraulic network, the upper head clamp assembly is configured to move upward away from the ground soil back to a starting position, and wherein, under an eighth force applied by the hydraulic network, the lower head clamp assembly is configured to move downward forcing the rod string farther into the ground soil.

3. The cone penetrometer testing sounding system of claim 1, wherein the at least one sensor is a plurality of sensors configured to detect soil resistance, pore pressure, soil behavior, acidity, temperature, and moisture.

4. The cone penetrometer testing sounding system of claim 1, further comprising:

a platform for an operator to be positioned while operating the cone penetrometer testing sounding system; and a set of valve controls for the operator to control motion of the upper head clamp assembly and the lower head clamp assembly.

5. The cone penetrometer testing sounding system of claim 1, wherein the hydraulic network is coupled to a machine hydraulic network of an auxiliary machine.

6. The cone penetrometer testing sounding system of claim 5, wherein the auxiliary machine is an excavator.

7. The cone penetrometer testing sounding system of claim 6, further comprising a frame configured to couple to a boom of the excavator, wherein the frame is configured to support all components of the cone penetrometer testing sounding system and be lifted by the excavator.

8. A cone penetrometer testing sounding system for testing ground soil, comprising:

a rod string comprising a plurality of connected rods;

an upper head clamp assembly comprising at least one upper clamp configured to selectively engage the rod string;

a lower head clamp assembly comprising at least one lower clamp configured to selectively engage the rod string, wherein the upper head clamp assembly and the lower head clamp assembly are positioned with the upper head clamp assembly above the lower head clamp assembly in a vertical configuration;

a cone penetrometer comprising at least one sensor configured to detect ground soil characteristics, wherein the cone penetrometer is configured to be coupled to a ground penetrating end of the rod string;

a power source configured to supply power to the upper head clamp assembly and the lower head clamp assembly;

wherein the at least one upper clamp is configured to selectively engage the rod string, wherein the at least one lower clamp is configured to selectively engage the rod string, wherein the upper head clamp assembly is configured to selectively move up and down forcing the cone penetrometer into the ground soil on a upper head clamp assembly downward stroke, and wherein the lower head clamp assembly is configured to selectively move up and down forcing the cone penetrometer into the ground soil on a lower head clamp assembly downward stroke.

9. The cone penetrometer testing sounding system of claim 8, further comprising a frame configured to support all components of the cone penetrometer testing sounding system.

10. The cone penetrometer testing sounding system of claim 9, wherein the frame is further configured with footings to support the cone penetrometer testing sounding system in a horizontal position.

11. The cone penetrometer testing sounding system of claim 8, further comprising at least one processor configured to control the power source to apply the power to the upper head clamp assembly and the lower head clamp assembly.

12. The cone penetrometer testing sounding system of claim 11, wherein the control of the upper head clamp assembly and the lower head clamp assembly is based on data output of the at least one sensor.

13. The cone penetrometer testing sounding system of claim 8, wherein the power source is a hydraulic motor.

14. A method of testing ground soil by a cone penetrometer testing sounding system, the method comprising:

providing an upper head clamp assembly comprising an upper clamp assembly;

providing a lower head clamp assembly comprising a lower clamp assembly;

providing a power source to a hydraulic network, wherein the hydraulic network is in fluid communication with the upper head clamp assembly, the upper clamp assembly, the lower head clamp assembly, and the lower clamp assembly;

actuating the upper clamp assembly to engage a rod string;

actuating the lower clamp assembly to disengage the rod string;

actuating the upper head clamp assembly to move downward pressing the rod string into the ground soil, wherein the rod string comprises a cone penetrometer comprising at least one sensor detecting a state of the ground soil;

actuating the lower head clamp assembly to move upward away from the ground soil; and obtaining and storing an output of the at least one sensor.

15. The method of claim 14, wherein the at least one sensor is a plurality of sensors configured to detect soil resistance, pore pressure, soil behavior, acidity temperature, and moisture.

16. The method of claim 14, further comprising controlling the hydraulic network by an operator providing inputs by a set of valve controls.

17. The method of claim 14, further comprising controlling the hydraulic network by at least one processor based on the output of the at least one sensor.

18. The method of claim 14, further comprising:

transmitting the output from the at least one sensor to at least one processor; and causing display of the output by a display monitor associated with the at least one processor.

19. The method of claim 14, further comprising providing a frame configured to support all components of the cone penetrometer testing sounding system and configured with footings to support the cone penetrometer testing sounding system in a horizontal position.

20. The method of claim 14, wherein the at least one sensor comprises an accelerometer, a strain gauge, a thermometer, a magnetometer, and a pH meter.

* * * * *